United States Patent [19]

Burkart

[11] Patent Number: 4,826,566

[45] Date of Patent: May 2, 1989

[54] RAPID DISOLUTION OF LIGNIN AND OTHER NON-CARBOHYDRATES FROM LIGNO-CELLULOSIC MATERIALS IMPREGNATED WITH A REACTION PRODUCT OF TRIETHYLENEGLYCOL AND AN ORGANIC ACID

[75] Inventor: Leonard F. Burkart, Nacogdoches, Tex.

[73] Assignee: Le Tourneau College, Longview, Tex.

[21] Appl. No.: 142,189

[22] Filed: Jan. 11, 1988

[51] Int. Cl.[4] ..... D21C 11/00

[52] U.S. Cl. ..... 162/14; 162/16; 162/50; 162/76; 530/507

[58] Field of Search ..... 162/50, 76, 250, 14, 162/16; 530/507

[56] References Cited

U.S. PATENT DOCUMENTS

| | | | |
|---|---|---|---|
| 3,442,753 | 5/1969 | Burkart | 162/76 |
| 3,522,230 | 7/1970 | Burkart | 162/76 |
| 4,451,331 | 5/1984 | Raggam et al. | 162/50 |

FOREIGN PATENT DOCUMENTS

| | | | |
|---|---|---|---|
| 1071672 | 2/1984 | U.S.S.R. | 162/50 |

*Primary Examiner*—Peter Chin

*Attorney, Agent, or Firm*—Leonard C. Brenner

[57] ABSTRACT

A method of rapidly and efficiently treating ligno-cellulosic material for removal of lignin and other non-carbohydrates as well as non-cellulosic carbohydrates from cellulosic matter. Such material is first impregnated with a liquor which is a reaction product obtained by mixing triethyleneglycol with an arylsulfonic or other organic acid. The impregnated material is then rapidly heated by microwaving or application of rf energy to a temperature between about 119 degrees Centigrade to 130 degrees Centigrade and maintained at that temperature for only two to five minutes to reduce the effects of hydrolysis. Thereafter, conventional filtration and washing techniques are applied to achieve a residue material suitable for further use as a wood pulp or for further hydrolysis for the production of organic chemicals.

5 Claims, No Drawings

RAPID DISOLUTION OF LIGNIN AND OTHER NON-CARBOHYDRATES FROM LIGNO-CELLULOSIC MATERIALS IMPREGNATED WITH A REACTION PRODUCT OF TRIETHYLENEGLYCOL AND AN ORGANIC ACID

BACKGROUND OF THE INVENTION

The present invention relates generally to a method of treating ligno-cellulosic materials such as ligneous vegetable matter for the removal of lignin and other non-carbohydrates as well as non-cellulosic carbohydrates from cellulosic matter. More specifically the invention relates to the impregnation of such ligno-cellulosic materials with a liquor and the rapid heating of same for the removal of lignin and other non-carbohydrates as well as non-cellulosic carbohydrates from cellulosic matter. The present invention provides for the rapid disolution of lignin and other non-carbohydrates from ligno-cellulosic materials using triethyleneglycol and catalytic amounts of an organic acid for the purpose of producing pulp or as a pre-hydrolysis step for the production of alcohols and other organic chemicals.

It is known that it is highly advantageous to derive useful products such as furfural compounds from ligneous carbohydrate materials occuring naturally in abundance. It is also highly advanteous to economically and expediently derive lignin from the same material for converting cellulosic materials of such matter, when desired, into pulp useful in the paper-making industry and for converting residual carbohydrate fractions into other commercially useful products. A liquor and a method for doing the above is disclosed in U.S. Pat. No. 3,442,753 issued May 6, 1969 to the present inventor. U.S. Pat. No. 3,442,753 and its continuation-in-part, U.S. Pat. No. 3,522,230 issued July 28, 1970 are both herewith incorporated by reference.

The processing costs of the method taught in U.S. Pat. No. 3,442,753 are highly dependent on the amount of liquor used, and the amount of time and energy needed in heating of ligneous vegetable matter.

Therefore it is an object of the present invention to provide a liquor efficient method of treating ligno-cellulosic matterials.

It is another object of the present invention to provide a method of ligno-cellulosic material treatment that requires only ⅓ to ½ the liquor required in known prior art methods.

Still another object of the present invention is to provide a method of lignin removal that requires much shorter heating times than that taught in the known prior art.

SUMMARY OF THE INVENTION

The above objects and others are achieved in the present invention by impregnating ligno-cellulosic materials with a liquor like that formed of triethyleneglycol in the presence of a catalytic amount of arylsufonic acid or other high boiling organic acid, pressing or draining off the excess liquor, rapidly heating the materials for about two to five minutes (which may be done at atmospheric pressure) to a temperature of about 120 degrees Centigrade to 130 degrees Centigrade, removing the liquor and dissolved non-carbohydrate material by washing the residual material with ethanol or other alcohol followed by draining or centrifugation, and subsequently precipating out from the reclaimed liquor the non-carbohydrate fraction by the addition of water. The resulting precipitate is lignin material which may be recovered by filtration, washed with fresh water and dried at temperatures below 100 degrees Centigrade to prevent self-polymerization.

At this point, the residual carbohydrate material from which the lignin-rich liquor was separated may be washed for example with warm water and dried by suitable methods to provide a high quality wood pulp.

In the alternative, the residual carbohydrate material may be further processed by treating in fresh liquor at higher temperatures until the cell structure of the material is completely disrupted and goes into solution or suspension. Furfural, 5-hydrodroxymethylfural and other organic materials may be separated from solution by steam distillation or other suitable means known in the art.

It will be recognized that spent liquor from any of the above steps may be reconcentrated by evaporation of water at reduced pressure and reused in the process with freshly prepared liquor.

In order to achieve rapid heating, heating is preferably generated from the inside out rather than outside in. Such heating is derived from radio-frequency (rf) energy or microwave energy (as in a conventional microwave oven). Initial heating may be started by microwave heating and continued for the next few minutes by conventional heating methods.

An advantage of the present invention is that the impregnated material may be stored for relatively long periods of time since the liquor has a very high vapor pressure and evaporates extremely slowly at normal temperatures. The liquor also inhibits decay of the impregnated ligno-cellulosic material.

Another advantage of the present invention is that the amount of liquor required for impregnating is about ⅓ to ½ the amount needed for the prior art liquor covering method.

Yet another advantage of the present invention is that the heating process is greatly reduced from about ½ hour to about 5 minutes or less.

Still yet another advantage of the present invention is that the cooking process can be done at atmospheric pressure thus not requiring special high-pressure cooking vessels as is commonly required in the prior art.

Still yet another advantage of the present invention is that the short heating process minimizes the pre-hydrolysis action by which cellulosic material (pulp) is degraded thus reducing its viscosity to a point where quality paper products are no longer obtainable.

Still yet another advantage of the present invention is that since less liquor is used than in prior art methods, less water is needed for the recovery of the lignin from the liquor and hence less energy is required to renovate and reclaim the spent liquor.

Still yet another advantage of the present invention is that since the used liquor is substantially all recovered for re-use, the process should lend itself to a closed system with very little air or water pollution.

PREFERRED EMBODIMENT OF THE PRESENT INVENTION

Preferably the method of the present invention begins with a liquor prepared in a fashion as taught in U.S. Pat. No. 3,442,753 issued May 6, 1969. Dry wood sawdust or other like material is pressure impregnated with the liquor to fill the cell lumens with liquor. Once the material is impregnated, excess liquor is drained or pressed off. Centrifugal forces may also be applied if desired to assist in the removal of excess liquor. The recovered liquor may be used for additional processing.

The impregnated material may be stored for long periods because the liquor inhibits decay. Generally, it is anticipated that the impregnated material will be used shortly. The impregnated material is heated rapidly at atmospheric pressure preferably by either microwaving or applying radio-frequency (rf) energy to raise the temperature to about between 119 degrees Centigrade to 130 degrees Centigrade for pulping and the generation of cellulose derived products. The material is held at the elevated temperatures for 2 to 5 minutes. Conventional heating may be used for good temperature regulation once the elevated temperatures are achieved. The rapid heating process limits the amount of undesirable hydrolysis that occurs while solubilizing the lignin and some non-cellulosic carbohydrates present in the impregnated material to produce a high cellulose pulp.

In some cases where pulp for paper products is not the goal of the process, temperatures at about 140 degrees Centigrade may be used to enhance the subsequent hydrolysis for the production of organic chemicals.

After the short rapid heating process, the material is quenched rapidly in a bath of alcohol or the like to remove the liquor and disolve the solubilized lignin and to prevent further degradative hydrolysis of the material. The alcohol and liquor are drained from the pulp and the alcohol then flashed off the liquor and disolved lignin under reduced pressure and reclaimed. Two volumes of water are then added to the liquor to precipitate out the disolved lignin which is recovered by centrifugation or pressure filtration. The liquor is recovered by removing water under reduced pressure and can be re-used over and over again. Since the amount of liquor is reduced by the present impregnating method, the amount of water needed for precipitation is reduced in like volume. At this point, the residual wood fraction is suitable for further processing as desired.

EXAMPLE 1

Triethyleneglycol was mixed and reacted with approximately 0.5 to 1.0 percent w/w with paratoluenesulfonic acid by letting the resulting solution stand approximately 24 hours. The reaction time can be reduced by heating the mixture to a temperature of about 125 degrees Centigrade to about 135 degrees Centigrade and maintaining the mixture at said temperature for about one hour. The resultant solution of triethyleneglycol-paratoluesulfonic acid and reaction products was then used as a liquor as will be described. Essentially dry wood sawdust was covered with the liquor and placed in a vacuum desicator. A vacuum was then drawn on the desicator for approximately 15 minutes to remove air from the sawdust. The resulting air pressure when the vacumm was broken forced the liquor into the sawdust thus impregnating it with liquor. Excess liquor was then drained off from the impregnated material. The impregnated material was then placed in a conventional 600 watt microwave cooking oven and heated for 2 to 4 minutes to rapidly raise the temperature of the impregnated material to between about 119 degrees Centigrade and 130 degrees Centigrade. The mixture was then immediately washed with ethanol to stop further hydrolysis of the carbohydrates and to remove the liquor and disolved non-carbohydrate substances, primarily lignin. The liquor free residua (pulp) was then washed thoroughly with warm water to remove any water soluble carbohydrates and was ready for further processing as desired. The ethanol was removed from the used liquor under reduced pressure and reclaimed for re-use. Two volumes of water were then added to the liquor to precipitate out disolved lignin which was collected by centrifugation, washed with warm water and dried. The liquor was reclaimed for re-use by removing the water under reduced pressure. Fresh liquor was added to the residual wood or carbohydrate fraction and the temperature was raised to the range of about 140 degrees Centigrade to about 160 degrees Centigrade and maintained at that level for 2 to 4 minutes in the microwave oven to reduce the cellulosic material into a very fine powdered form and convert non-cellulosic carbohydrates to sugars or furfurals of which most was subsequently reclaimed for further processing to useful products. The powdered cellulose is easily bleached and prepared for the many industrial and pharmaceutical uses of powdered cellulose or it can be further hydrolysed to glucose for the production of ethanol and other organic chemicals. The glycol liquor was then recovered as described above.

EXAMPLE 2

Triethyleneglycol was mixed and reacted with approximately 0.5 to 1.0 percent w/w with paratoluenesulfonic acid by letting the resulting solution stand approximately 24 hours. The reaction time can be reduced by heating the mixture to a temperature of about 125 C. degrees to about 135 C. degrees and maintaining the mixture at said temperature for a about one hour. The resultant solution of triethyleneglycol, paratoluesulfonic acid and reaction products was then used as a liquor as will be described. Essentially dry pulp wood chips were covered with the liquor and placed in a vacuum desicator as described in Example 1 to impregnate the chips with the liquor. Excess liquor was then drained off from the impregnated material. The impregnated material was then placed in a conventional 600 watt microwave cooking oven and heated for 2 to 4 minutes to rapidly raise the temperature of the impregnated material to between about 119 degrees Centigrade and 130 degrees Centigrade. Then the liquor containing extracted lignin was drained and separated from the residue of soft disintegrated wood fibers. The wood fiber residue which was washed with ethyl alcohol to remove residual liquor and disolved lignin and was then further washed with water can be easily bleached to produce a high quality pulp for use in paper products or for a disolving pulp to produce rayons and other chemically derived cellulose products. Lignin was recovered from the liquor and the liquor reclaimed as in Example 1.

Thus provided by the present invention is an improved rapid efficient method of delignifying wood and other ligneous vegetable matter as well as effectively pulping or digesting such matter and deriving valuable organic compounds therefrom.

It is noted that for the liquor prepared as taught in U.S. Pat. No. 3,442,753 is preferred over conventional Kraft pulping liquors which are basic liquors and are electrolytic enough to produce arcing and other deteriorative effects if heated by microwaves or rf.

The present invention, therefore, is well adapted to carry out the objects and attain the ends and advantages mentioned as well as others inherent therein. The composition and process may be restored to without departing from the spirit and scope of the invention as hereinafter claimed.

What is claimed is:

1. A method of treating ligneous vegetable matter to effect removal of non-cellulosic material therefrom comprising:

impregnating said matter with an extraction liquor, said extraction liquor being a reaction product obtained by mixing triethyleneglycol with at least about 0.5 percent by total weight of an organic acid;

removing excess liquor from said impregnated matter;

heating said impregnated matter to a temperature of about between 119 degrees Centigrade and 130 degrees Centigrade, said heating method being selected from rapid rf and microwave heating methods;

maintaining said impregnated matter at said temperature of about between 119 degrees Centigrade and 130 degrees Centigrade for only about 2 to 5 minutes to solubulize non-cellulosic material therefrom; and separating said extraction liquor from said heated impregnated matter to provide a liquor rich in non-cellulosic material.

2. The method of claim 1 wherein said reaction product is obtained by mixing triethyleneglycol with an arylsulfonic acid.

3. A method of deriving lignin from ligneous vegetable matter comprising:

impregnating said matter with an extraction liquor, said extraction liquor being a reaction product obtained by mixing triethyleneglycol with at least about 0.5 percent by total weight of an organic acid;

removing excess liquor from said impregnated matter;

heating said impregnated matter to a temperature of about between 119 degrees Centigrade and 130 degrees Centigrade, said heating method being selected from rapid rf and microwave heating methods;

maintaining said impregnated matter at said temperature of about between 119 C. degrees and 130 C. degrees for only about 2 to 5 minutes;

separating said extraction liquor from said heated impregnated matter to provide a lignin-rich liquor;

adding about one to two and one-half volumes of water to said lignin-rich liquor to precipitate the lignin; and filtering, washing, and drying said lignin.

4. The method of claim 3 wherein said reaction product is obtained by mixing triethyleneglycol with an arylsulfonic acid.

5. A method of deriving lignin from ligneous vegetable matter comprising:

impregnating said matter with an extraction liquor, said extraction liquor being a reaction product obtained by mixing triethyleneglycol with at least about 0.5 percent by total weight of an arylsulfonic acid;

removing excess liquor from said impregnated matter;

heating said impregnated matter to a temperature of about between 119 degrees Centigrade and 130 degrees Centigrade, said heating method being selected from rapid rf and microwave heating methods;

maintaining said impregnated matter at said temperature of about between 119 degrees Centigrade and 130 degrees Centigrade for only about 2 to 5 minutes to produce solubulized lignin;

rapidly quenching said heated impregnated matter in alcohol to remove said extraction liquor and disolve said solubilized lignin;

separating said alcohol and said extraction liquor with said disolved lignin from said heated impregnated matter;

separating said alcohol from said extraction liquor with said disolved lignin;

adding about one to two and one-half volumes of water to said extraction liquor with said disolved lignin to precipitate said lignin; and filtering, washing, and drying said precipitated lignin.

* * * * *